US005165840A

United States Patent [19]

McKinney

[11] Patent Number: 5,165,840

[45] Date of Patent: Nov. 24, 1992

[54] CLAMP ATTACHMENT FOR A LIFT TRUCK

[75] Inventor: Danny R. McKinney, Union Church, Miss.

[73] Assignee: Taylor Machine Works, Inc., Louisville, Miss.

[21] Appl. No.: 725,752

[22] Filed: Jun. 17, 1991

[51] Int. Cl.[5] ..... B66F 9/00

[52] U.S. Cl. ..... 414/607; 104/32.1; 187/9 R; 414/608; 414/663; 414/620

[58] Field of Search ..... 104/32.1, 33, 262; 414/607, 608, 426, 427, 589, 590, 662, 663, 665, 666, 667, 668, 669, 670, 671, 672, 908, 910, 623, 911, 626, 618, 619, 620; 187/9 R

[56] References Cited

U.S. PATENT DOCUMENTS

| | | | |
|---|---|---|---|
| 2,370,842 | 3/1945 | Christie | 104/32.1 X |
| 2,505,003 | 4/1950 | Perry et al. | 104/32.1 |
| 3,438,523 | 4/1969 | Vik . | |
| 3,507,352 | 4/1970 | Williamson | 414/663 X |
| 3,528,569 | 9/1970 | Barry . | |
| 3,633,777 | 1/1972 | Snelling, Jr. et al. | 414/608 |
| 3,764,032 | 10/1973 | Ward | 414/608 |
| 3,881,620 | 5/1975 | Walker . | |
| 4,437,807 | 3/1984 | Perrott | 414/620 |
| 4,583,902 | 4/1986 | Riley | 414/261 |
| 4,600,350 | 7/1986 | Matthewson et al. | 414/267 |
| 4,657,469 | 4/1987 | Beierle et al. | 414/607 |
| 4,664,576 | 5/1987 | Coe . | |
| 4,781,516 | 11/1988 | Cripe et al. | 414/555 |
| 4,952,118 | 8/1990 | Macmillan | 414/788.2 |

FOREIGN PATENT DOCUMENTS

| | | | |
|---|---|---|---|
| 481906 | 8/1929 | Fed. Rep. of Germany | 104/32.1 |
| 8800569 | 1/1989 | PCT Int'l Appl. | 414/607 |
| 1423513 | 2/1976 | United Kingdom | 414/608 |

*Primary Examiner*—Frank E. Werner

*Attorney, Agent, or Firm*—Walker, McKenzie & Walker

[57] ABSTRACT

A clamp attachment for use with a lift truck for handling rail car bogies. The clamp attachment includes an upper frame that is attached to the carriage of the lift truck for upward and downward movement therewith. A lower frame is movably suspended from the upper frame by four chains. A pair of clamps assemblies are pivotally mounted on the lower frame and actuated by hydraulic cylinders to cause clamping and unclamping of the axles of the rail car bogie for the lifting and lowering of the rail car bogie. A plurality of hydraulic cylinders are arranged to move the lower frame and clamp devices therewith into any desired direction for the maneuvering of the rail car bogie.

10 Claims, 3 Drawing Sheets

CLAMP ATTACHMENT FOR A LIFT TRUCK

BACKGROUND OF THE INVENTION

1. Field of the Invention

The present invention relates, in general, to a clamp attachment for use with a lift truck for handling rail car bogies.

2. Information Disclosure Statement

A preliminary patentability search in Class 294, subclasses 904 and Class 414, subclasses 607, 619, 620, 621, 622, 626, 629, 663, 664, and 912 disclosed the following patents which may relate to the present invention: Vik, U.S. Pat. No. 3,438,523 issued Apr. 15, 1969; Barry, U.S. Pat. No. 3,528,569 issued Sep. 15, 1970; Walker, U.S. Pat. No. 3,881,620 issued May 6, 1975; Perrott, U.S. Pat. No. 4,437,807 issued Mar. 20, 1984; Matthewson et al, U.S. Pat. No. 4,600,350 issued Jul. 15, 1986; Riley, U.S. Pat. No. 4,583,902 issued Apr. 22, 1986; Coe, U.S. Pat. No. 4,664,576 issued May 12, 1987; Cripe et al, U.S. Pat. No. 4,781,516 issued Nov. 1, 1988; and Macmillan, U.S. Pat. No. 4,952,118 issued Aug. 28, 1990.

Vik discloses load clamping and lifting apparatus for materials handling equipment including a power operated apparatus adapted to be mounted upon a vehicle for clamping and articulating a load about a horizontal axis.

Barry discloses means to hold down, release and transfer cargo pallets, containers, or vehicles to vehicles for transportation or for storage and in particular to means to automatically hook a load down and to automatically release it when engaged.

Walker discloses a bumper, cable and/or grapple type pulpwood handling machine. The grapple is rotatably driven about a vertical axis to better position the pulpwood pieces. Additionally, the grapple normally swings freely about a horizontal axis; however, brake structure is included to selectively stabilize the grapple and its load or prevent swinging movement thereof about the horizontal axis.

Perrott discloses a wheeled trailer frame carrying unit attachment for a lift truck. The wheeled frame remaining after removal therefrom of a detachable cargo container is gripped by clamping mechanism of a carrying unit mounted on a lift truck, then raised above the ground nd pivoted from its normal horizontal position to a vertical position for transport to a multiple storage unit.

Matthewson et al discloses a method and apparatus for handling container chassis. It includes a pair of upper and lower laterally-spaced forks and a clamp-positioning means cooperating with the forks to rotate the forks and any chassis gripped thereby through 180 degrees.

Riley discloses a method and system for storing wheeled frames of detachable cargo container type trailers. The wheeled frame remaining after removal of the detachable cargo container, is gripped by clamping mechanism of a carrying unit mounted on a tractor or lift truck, then elevated above the ground and pivoted from its normal horizontal disposition to vertical position, and then transported to a multiple storage unit where it is deposited and retained in the vertical position removably in one of a plurality of compartments making up the storage unit.

Coe discloses apparatus and method for handling cargo container chassis. An attachment is provided for heavy duty forklift vehicles and the like and a method for its use to handle large elongate objects, particularly to lift, overturn, carry, stack and unstack truck trailer chassis designed to carry intermodal transport cargo containers.

Cripe et al discloses a rail bogie handling vehicle which includes equipment which has been added to a conventional hostler tractor. The added equipment includes a boom arm apparatus which is pivotally mounted to the tractor for movement from a stowed position adjacent the vehicle cab to a deployed position wherein it is resting upon and disposed across a fifth wheel coupling device of the tractor. The boom apparatus can be coupled to the rail bogie with a pick up shoe assembly. Then the boom apparatus can be lifted by elevating the fifth wheel coupling device so that the tractor can transport the rail bogie.

Macmillan discloses a system and apparatus for storage of wheeled trailer frames in horizontal stacks. The storage system includes a staircase-like support rack. The frames are stacked horizontally with their front ends supported by the rack and with their rear wheels nested.

As is known, rail-highway vehicles systems typically utilize separable rail car bogies. In such a system the rail car bogies are separable portions of so-called road railers or trailer trains, which run on the usual train rails and which include train wheels mounted on the ends of an axle which rollingly support the carriage of the rail car bogie. There is a king pin upstanding from the carriage and a cargo container which is carried by a pair of the rail car bogies. The cargo container has a socket into which fits the king pin so that the cargo container can be lifted from the rail car bogies by a crane or the like. Since the rail car bogies are left behind on the rail when the cargo containers are removed, typically there is a need for the bogies to be removed from the rails for the purpose of the bogies awaiting subsequent use thereof. Then when it is desired to use the bogies again, they must be replaced on the rails. It will be understood that the wheels of the bogies must be carefully and precisely aligned with the train tracks or rails in order to properly position the bogies on the rails. In addition, the difficulty of exactly positioning of the rail bogies by conventional means such as lift trucks, tractors, cranes or the like can be appreciated. Thus, for example, it was necessary to considerably maneuver the lifting apparatus such as the whole lift truck itself requiring great skill on the part of the operator of the lift truck.

SUMMARY OF THE INVENTION

The present invention is directed toward providing a clamp attachment for use with a powered vehicle such as a lift truck with the clamp attachment being adapted to pick up and maneuver the rail car bogies to a desired location after the cargo container has been lifted therefrom and then to place the rail car bogies back onto the rails, when it is desired to again utilize the rail car bogies for a subsequent placement of the cargo containers thereon.

One of the objects of the present invention is to provide such a clamp attachment which provides precise maneuverability of the rail car bogie with a minimum amount of maneuvering of the powered vehicle. A further object is to provide such a clamp attachment with which the rail car bogies may be quickly, easily and precisely maneuvered.

A further object is to provide such a clamp attachment which grips the bogie by its axles thereby keeping them in place and preventing their dropping out when the rest of the assembly is lifted off of the bearing block.

A further object is to provide such a clamp attachment including a plurality of chains by which the rail car bogies are freely suspended for movement in any desired direction and which includes actuation means for maneuvering the suspended rail car bogies in any direction as desired.

DESCRIPTION OF THE PREFERRED EMBODIMENT

Figure 1:
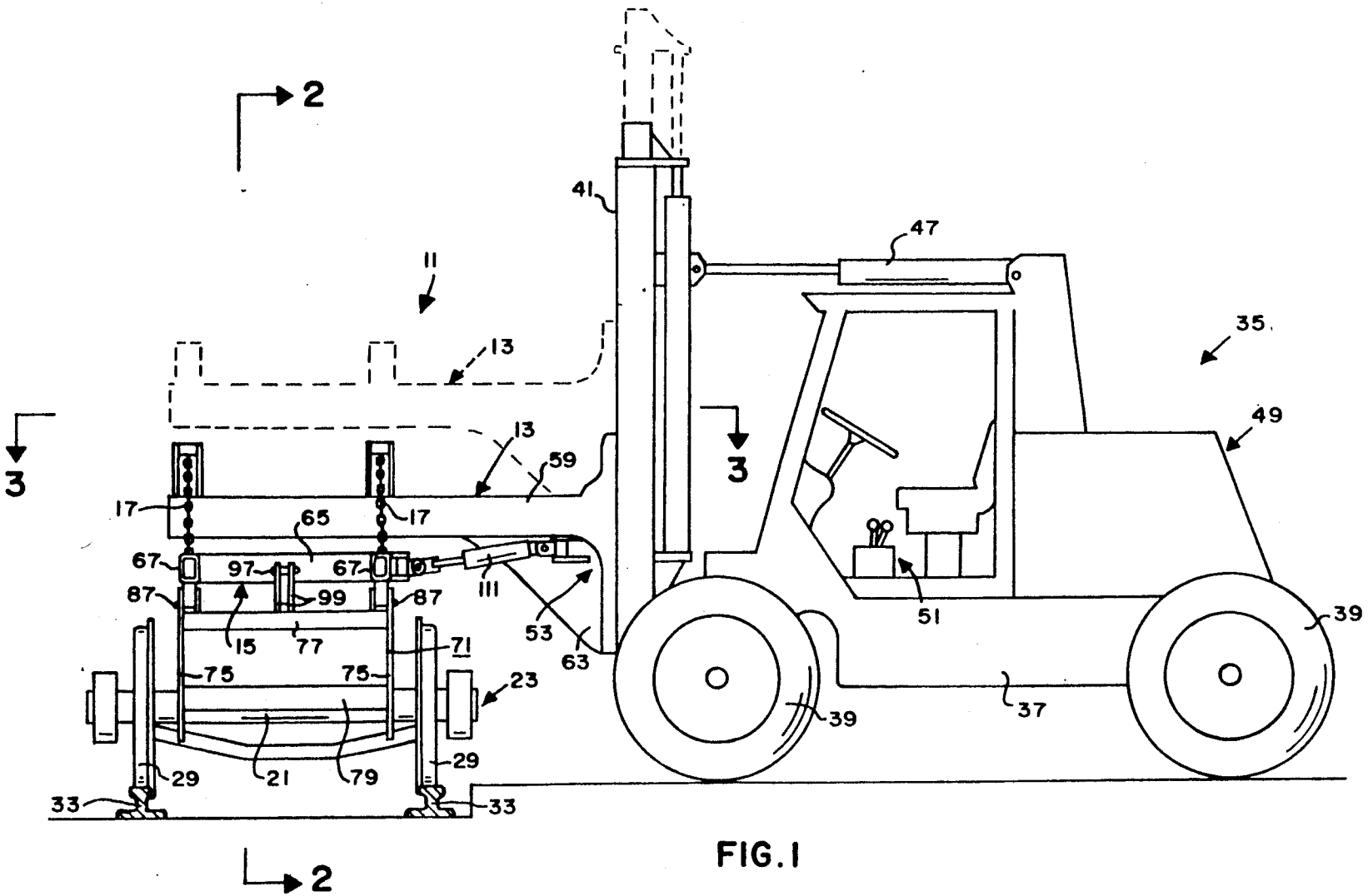
FIG. 1 is a side elevational view of the clamp attachment of the present invention attached to a lift truck and showing in solid lines, the attachment in a lowered engaged position with a rail car bogie on rails, and showing in broken lines the upper frame of the clamp attachment in a raised position and with the raised position of the carriage of the lift truck also being shown in broken lines.

The clamp attachment 11 of the present invention includes, in general, an upper frame 13, a lower frame 15, flexible support means which is preferably in the form of four chains 17 movably supporting lower frame 15 from upper frame 13 in a normally substantially horizontal position, clamp means 19 movably mounted on lower frame 15 for movement between a clamped position relative to the axles 21 of a typical rail car bogie 23 and a disengaged or unclamped position relative to the axles 21, actuator means 25 operably coupled to clamp means 19 for moving the clamp means selectively into said clamped and unclamped positions, and actuation means 27 operably coupled to upper frame 13 and lower frame 15 for moving the lower frame 15 relative to the upper frame 13 to position clamp means 19 properly relative to the axles 21 of rail car bogie 23 for the clamping and subsequent lifting thereof and to manipulate the rail car bogie after being lifted.

Rail car bogie 23 forms no part of the present invention and typically includes in addition to axles 21, a pair of wheels 29 on each axle 21, and body portion 31. In the drawings, the wheels 29 are shown typically engaging railroad tracks or rails 33.

Clamp attachment 11 is adapted to be used with a powered vehicle such as the lift truck 35 of a construction well known to those skilled in the art and typically includes a body 37 supported by a plurality of wheels 39, a mast 41 positioned at the front end of the vehicle body 37 and a carriage 43 vertically movable on mast 43 as by means of hydraulic cylinders 45.

Mast 41 is preferably tiltably attached to vehicle body 37 in the usual manner, i.e., the mast 41 pivots about a horizontal axis as it is actuated by hydraulic tilting cylinders 47. In addition lift truck 35 includes the usual power means shown generally at 49 that includes an engine for driving the lift truck 35 and a hydraulic system, well known to those skilled in the art, including controls 51 for actuating and controlling cylinders 45, 47, and the other cylinders included in clamp attachment 11 to be described hereinafter.

Upper frame 13 of clamp attachment 11 is preferably fixedly and removably attached to carriage 43 by suitable means well known to those skilled in the art, for vertical movement with the carriage. If desired, a rotator, well known to those skilled in the art, may be provided between carriage 43 and upper frame 13 for rotating clamp attachment 11 about a horizontal axis.

Upper frame 13 includes a rearward base portion 53 which extends generally vertical and is the part of upper frame 13 that is attached to carriage 43. Rearward base portion 53 is of any suitable construction and preferably includes vertical members 55 and transverse members 57 fixedly attached by suitable means at the ends thereof to the vertical members 55.

Also, upper frame 13 includes a pair of spaced apart horizontal members 59 fixedly attached at the rearward ends thereof by suitable means, well known to those skilled in the art, to rearward base portion 53 and extend forwardly therefrom in cantilever fashion from the base portion. Also, upper frame 13 preferably includes transverse members 61 respectively fixedly attached at the ends of the transverse members to the forward and rearward ends of horizontal members 59 by suitable means well known to those skilled in the art. In addition, one or more gussets 63 are provided between horizontal members 59 and rearward base portion 53. Thus, from the foregoing it will be understood that upper frame 13 is rigid and is of open framework construction.

Lower frame 15 is also preferably of open framework construction made from suitable members which are interconnected. Thus, lower frame 15 preferably includes a pair of spaced apart fore and aft extending parallel members 65, parallel transverse members 67, and diagonal member 69 fixedly interconnected to establish the rigid lower frame 15.

Clamp means 19 preferably includes a first hook assembly 71 and a second hook assembly 73. First hook assembly 71 and second hook assembly 73 are preferably substantially identical and the following description of first hook assembly 71 will suffice for both.

First hook assembly 71 includes a pair of spaced hooks 75 and brace means which preferably includes an upper brace 77 and a lower brace 79 respectively fixedly attached at the ends thereof to hooks 75 by suitable means well known to those skilled in the art. Each of hooks 75 includes an elongated arm portion 81 and an arcuate foot portion 83 extending inwardly from the lower ends of arm portion 81 and adapted to hook under an axle 21 of rail car bogie 23 for the lifting thereof. Each hook 75 is preferably integral in construction with arm portion 81 being integrally attached to arcuate foot portion 83.

Suitable means pivotally attaches arm portions 81 of first hook assembly 71 to one side of lower frame 15 and which means preferably includes a pair of brackets 85 fixedly attached to one side of lower frame 15 by suitable means and pivot pins 87 extending through aligned apertures in brackets 85 and arm portions 81.

Figure 2:
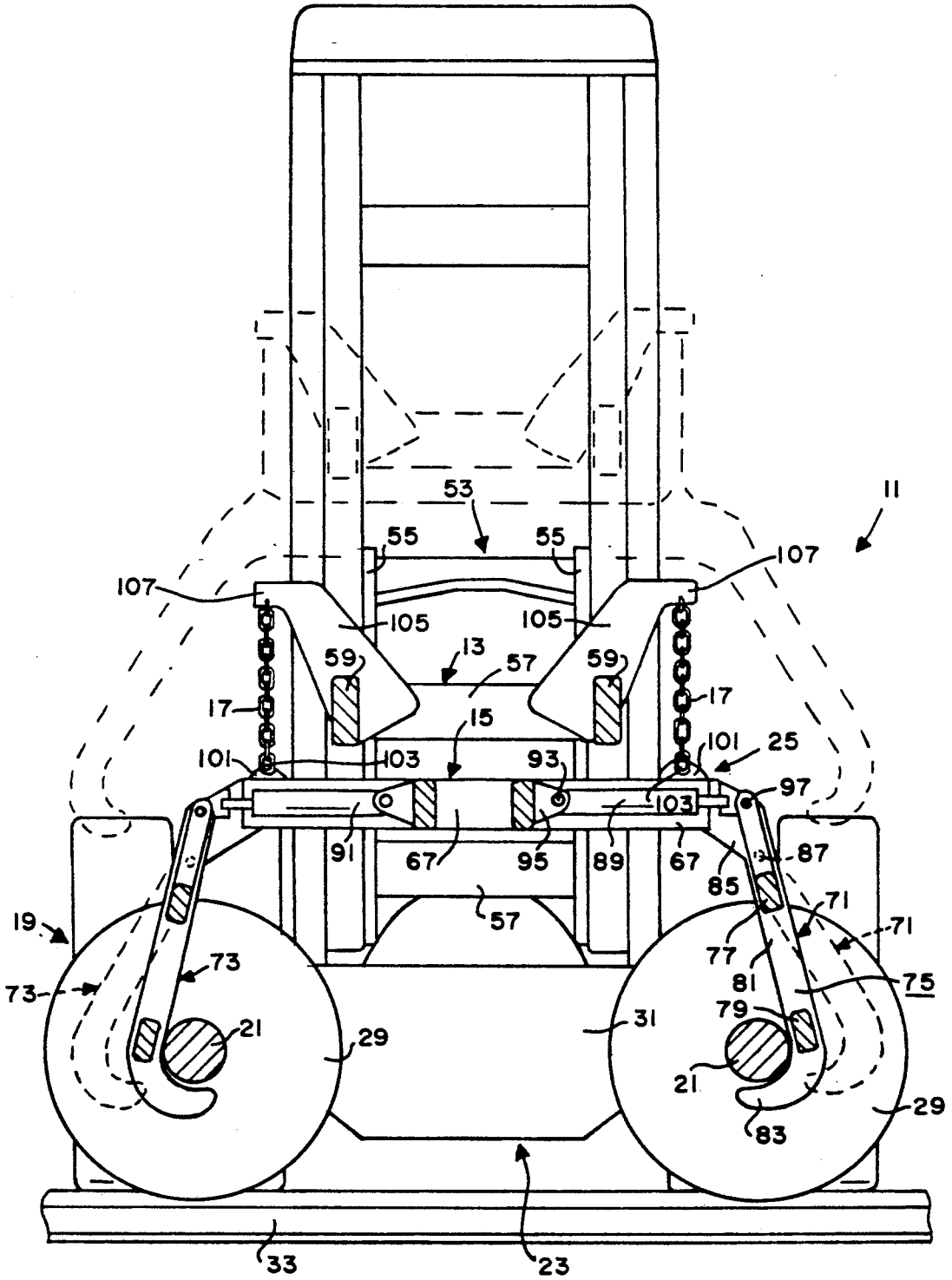
FIG. 2 is an enlarged sectional view taken as on the line 2—2 of FIG. 1 with certain parts being omitted for purposes of clarity and showing the clamp means in solid lines in a clamped position relative to the axles of the rail car bogie and showing in broken lines a first unclamped position adjacent the axles and an upper unclamped position with related structure in broken lines.

Similar means to that above described pivotally attaches the arm portions of second hook assembly 73 to the opposite side of lower frame 15 with the foot portions of the hooks of the first hook assembly 71 respectively extending towards the foot portions of the hooks of second hook assembly 73, as best seen in FIG. 2. The pivot means of the hook assemblies 71, 73 are respectively disposed intermediate the ends of the arm portions of the respective hook assemblies, also as best seen in FIG. 2.

Actuator means 25 preferably includes a pair of hydraulic cylinder means 89, 91 respectively operably coupled between first hook assembly 71 and lower frame 15 and between second hook assembly 73 and lower frame 15. Cylinder means 89 and cylinder means 91 and their coupling to the respective hook assemblies 71, 73 are preferably substantially identical and the following description relative to cylinder means 89 will suffice for both.

Cylinder means 89 is a double acting hydraulic cylinder/piston assembly well known to those skilled in the art and preferably connected to the hydraulic system of lift truck 35 and controlled by hydraulic controls 51 in a manner well known to those skilled in the art. The base end of cylinder means 89 is pivotally connected by suitable means as pivot pin 93 and lugs 95 to lower frame 15, and the opposite or rod end of cylinder means 89 is pivotally connected to first hook assembly 71 by suitable means as the pivot pin 97 and lugs 99 fixedly attached to the upper brace 77 of first hook assembly 71. Thus when cylinder means 89, 91 are extended, clamp means 19 is moved into a clamped position shown in solid lines in FIG. 2 and when the cylinder means 89, 91 are retracted, first hook assemblies 71, 73 are moved to an unclamped position shown in broken lines in FIG. 2.

There are preferably four chains 17 that are preferably of the same length and are attached at the lower ends thereof to the four corners of lower frame 15 by suitable means well known to those skilled in the art as by lugs 101 fixedly attached to the lower frame and with the end of the chain being coupled to the lugs as by means of pins 103. The upper ends of the chains 17 are preferably anchored to the upper frame 13 respectively by the anchor members 105. Each of the anchor members are fixedly attached adjacent the lower ends thereof respectively to the horizontal members 59 of upper frame 13 by suitable means well known to those skilled in the art. The anchor members 105 extend upwardly and outwardly beyond the horizontal members 59. Each of the anchor members 105 has an outwardly projecting portion 107 at the upper end thereof to which is attached an upper end of a chain 17 by suitable means well known to those skilled in the art. From the foregoing, it will be understood that lower frame 15 is normally freely movably supported from upper frame 13 so that the lower frame 15 can be moved in any selected direction or maneuver by actuation means 27.

Actuation means 27 includes at least one side shift hydraulic cylinder means 109 operably coupled to lower frame 15 and upper frame 13 for moving the lower frame 15 laterally relative to the upper frame 13. Also actuation means 27 includes a pair of slew and reach cylinders 111, 113 for slewing lower frame 15 relative to upper frame 13 and for moving lower frame 15 forwardly and rearwardly relative to the upper frame 13, as desired.

Side shift hydraulic cylinder 109, and slew and reach cylinders 111, 113 are preferably double acting hydraulic cylinders which are powered and controlled by the hydraulic system and controls 51 of the lift truck 35 in a manner well known to those skilled in the art.

The base end of slew and reach cylinder 111 is pivotally connected to upper frame 13 adjacent the rearward end of the upper frame preferably by a universal coupling 115 so that the base end of cylinder 111 can pivot about a vertical axis or pin 117 and a horizontal axis or pin 119. Universal coupling 115 is connected to slew and reach cylinder 111 and upper frame 13 by suitable well known means such as lugs or the like. The rod end of slew and reach cylinder 111 is pivotally connected to lower frame 15 adjacent the rearward end of the lower frame preferably by a universal coupling 120 so that the rod end of cylinder 111 can pivot about a vertical axis or pin 121 and a horizontal axis or pin 123. Universal coupling 120 is connected to slew and reach cylinder 111 and lower frame 15 by suitable well known means such as lugs or the like.

Similarly, the base end of slew and reach cylinder 113 is pivotally connected to upper frame 13 adjacent the rearward end of the upper frame preferably by a universal coupling 125 so that the base end of cylinder 113 can pivot about a vertical axis or pin 127 and a horizontal axis or pin 129. Universal coupling 125 is connected to slew and reach cylinder 113 and upper frame 13 by suitable well known means such as lugs or the like. The rod end of slew and reach cylinder 113 is pivotally connected to lower frame 15 adjacent the rearward end of the lower frame preferably by a universal coupling 131 so that the rod end of cylinder 113 can pivot about a vertical axis or pin 133 and a horizontal axis or pin 135. Universal coupling 131 is connected to slew and reach cylinder 113 and lower frame 15 by suitable well known means such as lugs or the like.

The base end of side shift cylinder 109 is pivotally connected to upper frame 13 adjacent the rearward end of the upper frame preferably by a universal coupling 137 so that the base end of cylinder 109 can pivot about a vertical axis or pin 139 and a horizontal axis or pin 141. Universal coupling 137 is connected to side shift cylinder 109 and upper frame 13 by suitable well known means such as lugs or the like. The rod end of side shift cylinder 109 is pivotally connected to lower frame 15 adjacent the rearward end of the lower frame preferably by a universal coupling 143 so that the rod end of cylinder 109 can pivot about a vertical axis or pin 145 and a horizontal axis or pin 147. Universal coupling 143 is connected to side shift cylinder 111 and lower frame 15 by suitable well known means such as lugs or the like.

Figure 3:
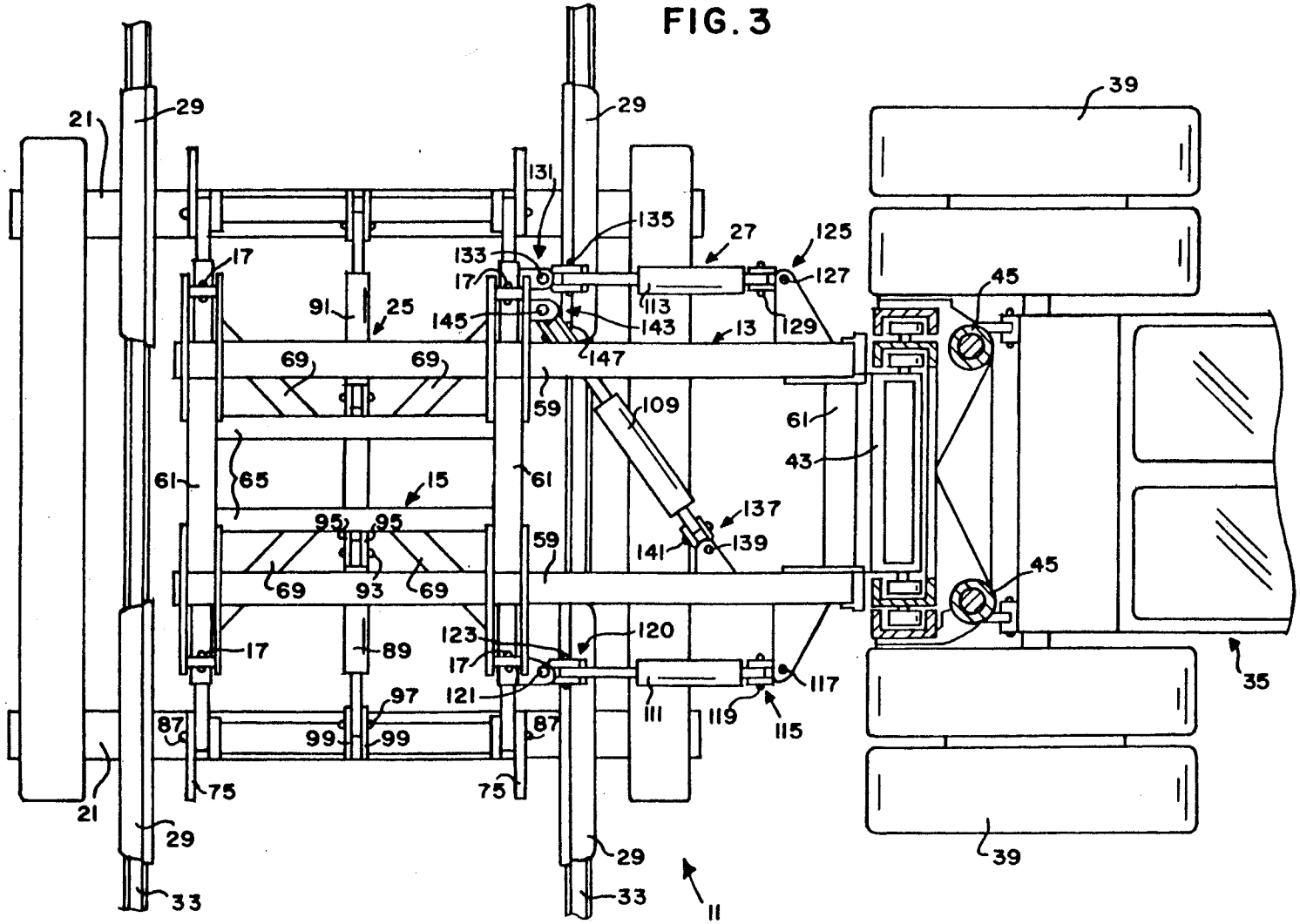
FIG. 3 is an enlarged sectional view taken as on the line 3—3 of FIG. 1 with certain parts being omitted for purposes of clarity.

Slew and reach cylinders 111, 113 are preferably arranged so that they establish a quadrilateral with portions of upper frame 13 and lower frame 15. Thus, slew and reach cylinders 111, 113 in the normal position shown in FIG. 3, are preferably parallel with one another and establish two of the opposing sides of the quadrilateral with the other two sides being: (1) an imaginary line extending between pivot points 117 and 127, as best seen in FIG. 3 and (2) an imaginary line extending between pivot points 121, 133. Side shift cylinder 109 is arranged preferably diagonally relative to upper frame 13 and lower frame 15 as best seen in FIG. 3 and preferably extends from the pivot point 139 intermediate the ends of the upper frame 13 but nearer the rearward end of the upper frame and spaced therefrom, diagonally towards the corner of lower frame 15 which is adjacent pivot 133.

From the foregoing arrangement, it will be understood that in the operation of the clamp attachment 11 of the present invention when the slew and reach cylinders 111, 113 are retracted together, the lower frame 15 carrying with it clamp means 19 will move or swing inwardly towards lift truck 35 and when the cylinders 111, 113 are extended, the lower frame 15 and clamp means 19 will move or swing away from the lift truck 35. Also it will be understood that when side shift cylinder 109 is retracted, lower frame 15 and clamp means 19 will move generally to the left as viewed by the operator of the lift truck 35 and when side shift cylinder 109 is extended, lower frame 15 and clamp means 19 will move in the opposite direction to the right. Additionally, it will be understood that when slew and reach cylinder 111 is retracted and slew and reach cylinder 113 is extended, lower frame 15 and clamp means 19 will move counterclockwise as viewed in FIG. 3. Conversely, when slew and reach cylinder 111 is extended and slew and reach cylinder 113 is retracted, lower frame 15 and clamp means 19 will move clockwise. Also it will be understood that the above mentioned movements are made possible since the lower frame 15 is movably suspended by the chain 17 which allow all desired movements independent of the lift truck 35. In addition, it will be understood that various other compound movements in addition to those described above can be made by various combinations of the movements of cylinders 111, 113 and 109. Thus, an exact and precise maneuvering and placement of the rail car bogie 23 is possible which is particularly important in placing the rail bogie back on the track.

Further, in the operation of the clamp attachment 11 of the present invention, it will be understood that in removing a rail car bogie 23 from the tracks, as for example for storage, the operator of the lift truck 35 drives the lift truck to a position, as for example to the position shown in FIG. 1, and with the clamp means 19 in an open or unclamped position shown in broken lines in the upper portion of FIG. 2, the operator then lowers the carriage 43 downwardly until the clamp means is in a position shown in broken lines in the lower portion of FIG. 2. Then, the proper alignment of the clamp means 19 relative to the axles 21 is made through the controls 51 causing actuation of on or more of the cylinders 109, 111 and/or 113. When the proper alignment is made, the controls 51 are actuated to cause the hook assemblies 71, 73 to move inwardly towards one another and into hooking engagement with the axles 21 as shown in solid lines in FIG. 2, whereupon the operator by the controls 51 causes the carriage 43 to move upwardly and lift the clamp attachment 11 and the rail car bogie 23 therewith. Then, the lift truck 35 may be maneuvered to take the rail car bogie to the desired location. In placing the rail car bogie onto rails, substantially the reverse of the above described operation is utilized.

From the foregoing it can be appreciated that the clamp attachment 11 of the present invention provides an efficient, effective and accurate means for removing and replacing a rail car bogie on a track and for other maneuvers of the rail car bogie, as desired.

Although the present invention has been described and illustrated with respect to a preferred embodiment and a preferred use therefor, it is not to be so limited since modifications and changes can be made therein which are within the full intended scope of the invention.

I claim:

1. A clamp attachment for use with a powered vehicle having a vertically movable carriage and means for mounting and vertically moving said carriage, said clamp attachment comprising:

(a) an upper frame attached to said carriage for vertical movement therewith;

(b) a lower frame;

(c) flexible support means for movably supporting said lower frame from said upper frame;

(d) clamp means movably mounted on said lower frame for movement between a clamped position relative to a pair of axles of a rail car bogie and a unclamped position relative to the pair of axles of the rail car bogie;

(e) actuator means operably coupled to said clamp means for moving said clamp means selectively into said clamped and unclamped positions; and (f) actuation means operably coupled to said upper frame and said lower frame for moving said lower frame relative to said upper frame to position said clamp means properly relative to the pair of axles of the rail car bogie for the clamping and subsequent lifting thereof and to manipulate the rail car bogie after being lifted.

2. A clamp attachment for use with a powered vehicle having a vertically movable carriage and means for mounting and vertically moving said carriage; said clamp attachment comprising:

(a) an upper frame attached to said carriage for vertical movement therewith;

(b) a lower frame;

(c) flexible support means for movably supporting said lower frame from said upper frame;

(d) clamp means movably mounted on said lower frame for movement between a clamped position relative to at least one axle of a rail car bogie and a unclamped position relative to at least one axle of the rail car bogie;

(e) actuator means operably coupled to said clamp means for moving said clamp means selectively into said clamped and unclamped positions; and (f) actuation means operably coupled to said upper frame and said lower frame for moving said lower frame relative to said upper frame to position said clamp means properly relative to at least one axle of the rail car bogie for the clamping and subsequent lifting thereof and to manipulate the rail car bogie after being lifted; said actuation means including at least one side shift hydraulic cylinder means operably coupled to said lower frame and said upper frame for moving said lower frame laterally relative to said upper frame, and said actuating means also including at least one slew and reach hydraulic cylinder means for slewing said lower frame relative to said upper frame and for moving said lower frame forwardly and rearwardly relative to said upper frame.

3. The clamp attachment of claim 2 in which said flexible support means includes four chains.

4. A clamp attachment for use with a powered vehicle having a vertically movable carriage and means for mounting and vertically moving said carriage; said clamp attachment comprising:

(a) an upper frame attached to said carriage for vertical movement therewith;

(b) a lower frame;

(c) flexible support means for movably supporting said lower frame from said upper frame;

(d) clamp means movably mounted unsaid lower frame for movement between a clamped position relative to at least one axle of a rail car bogie and a unclamped position relative to at least one axle of the rail car bogie;

(e) actuator means operably coupled to said clamp means for moving said clamp means selectively into said clamped and unclamped positions; and (f) actuation means operably coupled to said upper frame and said lower frame for moving said lower frame relative to said upper frame to position said clamp means properly relative to at least one axle of the rail car bogie for the clamping and subsequent lifting thereof and to manipulate the rail car bogie after being lifted; said actuation means including a pair of spaced apart slew and reach cylinders including universal coupling means coupling opposite ends of said slew and reach cylinders respectively to said lower frame and said upper frame adjacent opposite sides thereof, and establishing a quadrilateral with an imaginary line extending through said universal coupling means that respectively couple first ends of said slew and reach cylinders to said upper frame and with another imaginary line extending through said universal coupling means that respectively couple second ends of said slew and reach cylinders to said lower frame.

5. A clamp attachment for use with a powered vehicle having a vertically movable carriage and means for mounting and vertically moving said carriage; said clamp attachment comprising:

(a) an upper frame attached to said carriage for vertical movement therewith;

(b) a lower frame;

(c) flexible support means for movably supporting said lower frame from said upper frame;

(d) clamp means movably mounted on said lower frame for movement between a clamped position relative to a pair of axles of a rail car bogie and a unclamped position relative to the pair of axles of the rail car bogie; said clamp means including a first hook assembly and a second hook assembly, each of said hook assemblies including a pair of spaced hooks and brace means rigidly interconnecting said pair of hooks, each of said hooks including an elongated arm portion and an arcuate foot portion extending inwardly from a lower end of said arm portion and adapted to hook under one of the axles of the rail car bogie for the lifting thereof, means pivotally attaching said arm portions of said first hook assembly to one side of said lower frame and pivotally attaching said arm portions of said second hook assembly to an opposite side of said lower frame with said foot portions of said hooks of said first hook assembly respectively extending towards said foot portions of said hooks of said second hook assembly;

(e) actuator means operably coupled to said clamp means for moving said clamp means selectively into said clamped and unclamped positions; and (f) actuation means operably coupled to said upper frame and said lower frame for moving said lower frame relative to said upper frame to position said clamp means properly relative to the axles of the rail car bogie for the clamping sand subsequent lifting thereof and to manipulate the rail car bogie after being lifted.

6. The clamp means of claim 5 in which said actuator means includes a pair of hydraulic cylinder means respectively operably coupled between said first hook assembly and said lower frame and between said second hook assembly and said lower frame.

7. A clamp attachment for use with a powered vehicle having a vertically movable carriage and means for mounting and vertically moving said carriage, said clamp attachment comprising:

(a) an upper frame attached to said carriage for vertical movement therewith;

(b) a lower frame;

(c) flexible support means for movably supporting said lower frame from said upper frame;

(d) clamp means movably mounted on said lower frame for movement between a clamped position relative to a pair of axles of a rail car bogie and an unclamped position relative to the pair of axles of the rail car bogie, said clamp means including:

(i) a first hook assembly and a second hook assembly, each of said hook assemblies including a pair of spaced hooks and brace means rigidly interconnecting said pair of hooks, each of said hooks including an elongated arm portion and an arcuate foot portion extending inwardly from a lower end of said arm portion and adapted to hook under one of the pair of axles of the rail car bogie for the lifting thereof, and (ii) means pivotally attaching said arm portions of said first hook assembly to one side of said lower frame and pivotally attaching said arm portions of said second hook assembly to an opposite side of said lower frame with said foot portions of said hooks of said first hook assembly respectively extending towards said foot portions of said hooks of said second hook assembly;

(e) actuator means operably coupled to said clamp means for moving said clamp means selectively into said clamped and unclamped positions, said actuator means including a pair of hydraulic cylinder means respectively operably coupled between said first hook assembly and said lower frame and between said second hook assembly and said lower frame; and (f) actuation means operably coupled to said upper frame and said lower frame for moving said lower frame relative to said upper frame to position said clamp means properly relative to the axles of the rail car bogie for the clamping and subsequent lifting thereof and to manipulate the rail car bogie after being lifted, said actuation means including:

(i) at least one side shift hydraulic cylinder means operably coupled to said lower frame and said upper frame for moving said lower frame laterally relative to said upper frame, and (ii) at least one slew and reach hydraulic cylinder means for slewing said lower frame relative to said upper frame and for moving said lower frame forwardly and rearwardly relative to said upper frame.

8. The clamp attachment of claim 7 in which said flexible support means includes four chains.

9. The clamp means of claim 7 in which said actuation means includes a pair of spaced apart slew and reach cylinders including universal coupling means coupling opposite ends of said slew and reach cylinders respectively to said lower frame and said upper frame adjacent opposite sides thereof, and establishing a quadrilateral with an imaginary line extending through said universal coupling means that respectively couple first ends of said slew and reach cylinders to said upper frame and with another imaginary line extending through said universal coupling means that respectively couple second ends of said slew and reach cylinders to said lower frame.

10. The clamp means of claim 9 in which said actuator means includes a pair of hydraulic cylinder means respectively operably coupled between said first hook assembly and said lower frame and between said second hook assembly and said lower frame.

* * * * *